US006981678B2

(12) United States Patent
Fu-Liang

(10) Patent No.: US 6,981,678 B2
(45) Date of Patent: Jan. 3, 2006

(54) CEILING FAN MOUNTING BALL

(75) Inventor: Chang Fu-Liang, Feng Yuan (TW)

(73) Assignee: Craftmade International, Inc., Coppell, TX (US)

( * ) Notice: Subject to any disclaimer, the term of this patent is extended or adjusted under 35 U.S.C. 154(b) by 162 days.

(21) Appl. No.: 10/342,425

(22) Filed: Jan. 14, 2003

(65) Prior Publication Data

US 2003/0213883 A1 Nov. 20, 2003

(51) Int. Cl.
*H05K 5/00* (2006.01)

(52) U.S. Cl. ..... 248/343; 248/342; 248/344; 416/500

(58) Field of Classification Search ..... 248/343, 248/342, 344, 323, 324, 610; 416/244 R, 416/500

See application file for complete search history.

(56) References Cited

U.S. PATENT DOCUMENTS 4,448,388 A * 5/1984 Dennis et al. ..... 248/663
4,697,777 A * 10/1987 Yang ..... 248/343
4,722,631 A * 2/1988 Tagami ..... 403/133
4,729,725 A * 3/1988 Markwardt ..... 417/423.15
4,738,436 A * 4/1988 Loggers ..... 267/150
5,090,654 A * 2/1992 Ridings et al. ..... 248/343
5,360,282 A * 11/1994 Nagengast et al. ..... 403/131
5,613,832 A * 3/1997 Su ..... 416/244 R
5,851,107 A * 12/1998 Wang ..... 416/244 R
5,902,656 A * 5/1999 Hwang ..... 428/36.91
5,947,436 A * 9/1999 Bucher et al. ..... 248/345
5,984,640 A * 11/1999 Wang ..... 416/244 R
6,042,072 A * 3/2000 Chi-Nan ..... 248/343
6,203,279 B1 * 3/2001 Moody et al. ..... 416/244 R
6,234,757 B1 5/2001 Pearce ..... 416/244 R
6,280,145 B1 * 8/2001 Liu ..... 416/244 R
6,305,974 B1 * 10/2001 Tseng ..... 439/537
6,598,846 B1 * 7/2003 Lackey, Jr. ..... 248/343

* cited by examiner

*Primary Examiner*—Ramon O. Ramirez
*Assistant Examiner*—Steven Marsh
(74) *Attorney, Agent, or Firm*—Haynes and Boone, LLP

(57) ABSTRACT

A fan ball for mounting a ceiling fan is described, wherein the fan ball has damping means for preventing the fan ball from mechanically transferring any appreciable degree of vibration to the fan, thereby preventing undesirable noise.

18 Claims, 2 Drawing Sheets

CEILING FAN MOUNTING BALL

BACKGROUND

The present disclosure relates generally to a ceiling fan mounting ball (hereinafter "fan ball"). Fan balls provide the ball portion of a ball and socket type interaction, thereby allowing a ceiling fan to hang straight even when mounted on a variety of sloped surfaces.

In the past, fan balls mechanically transferred an appreciable degree of vibration from the fan's environment to the fan, thereby causing undesirable noise.

Therefore, what is needed is a fan ball having dampening means to prevent vibration.

DESCRIPTION

Figure 1:
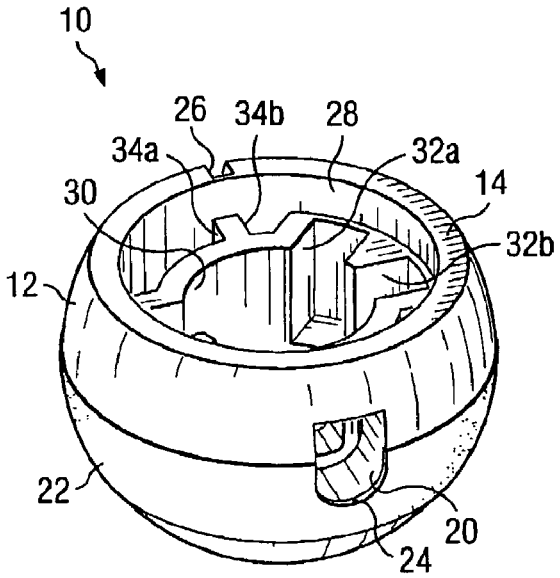
FIG. 1 is a perspective view of a fan ball according to one embodiment of the present invention.
Figure 3:
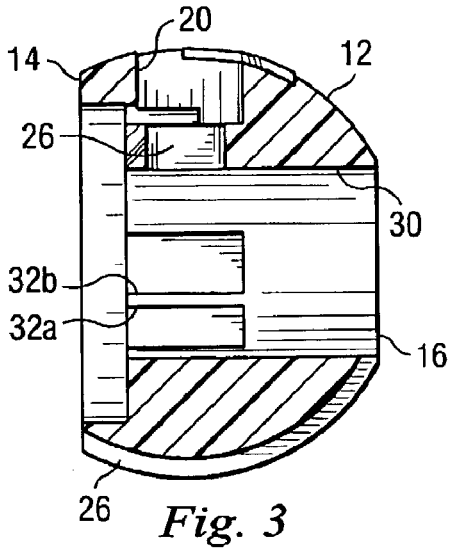
FIG. 3 is a cross-sectional view of the fan ball taken along the line 3—3 in FIG. 2.
Figure 2:
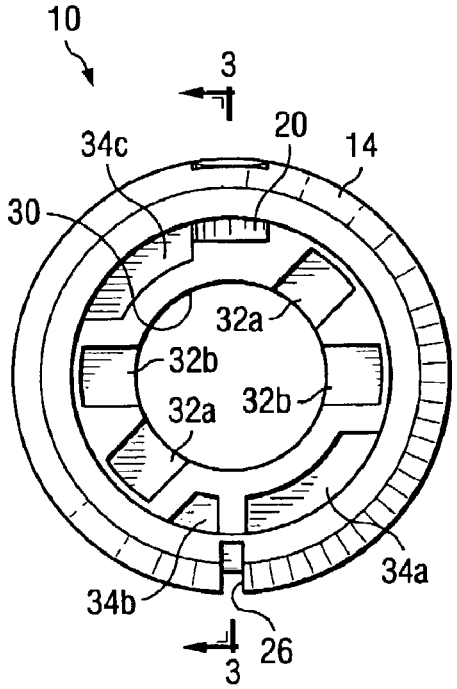
FIG. 2 is a top plan view of the fan ball.

Referring to FIGS. 1–3, a fan ball according to one embodiment of the present invention is referred to generally by the reference numeral 10. The fan ball 10 comprises an outer surface 12, a top edge 14, and a bottom edge 16 (FIG. 3).

As shown in FIG. 3, the outer surface 12 is generally curved, the diameter of the fan ball 10 increasing from the bottom edge 16 until reaching its maximum diameter at a point below the top edge 14. The curvature of the outer surface 12 corresponds to the shape of a conventional mounting bracket, as will be described with reference to FIG. 6. A bore 20 is formed radially through a portion of the fan ball 10 for reasons to be described with reference to FIG. 6.

Figure 4:
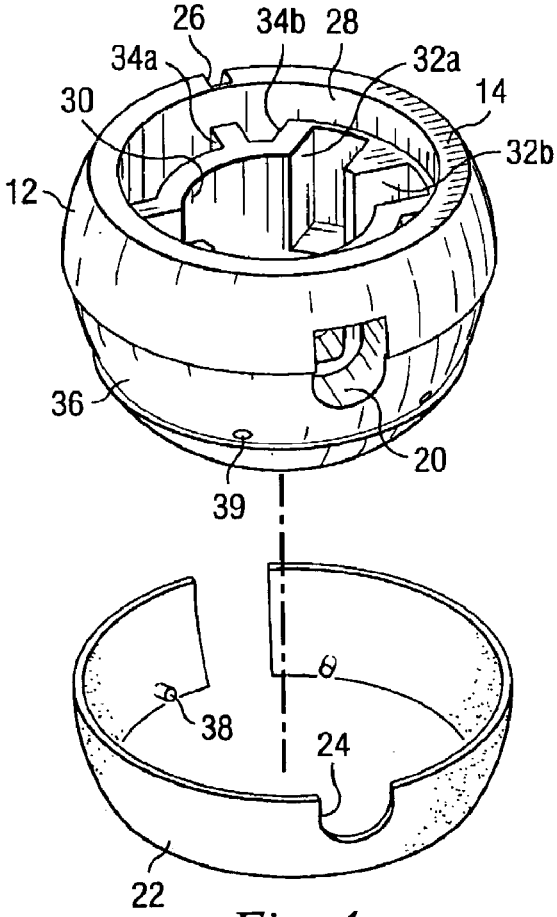
FIG. 4 is an exploded view of the fan ball.

A damping ring 22, which will be discussed in greater detail with reference to FIG. 4, is disposed on the fan ball 10 and extends partially circumferentially about the outer surface 12. The damping ring 22 may be formed of rubber, polyethylene, or any material having a damping ability, such materials being well known to those skilled in the art. A slot 24 may further be formed in the damping ring 22 to correspond with the bore 20 formed through the fan ball 10.

A channel 26 is formed along the outer surface 12, extending between the top edge 14 and the bottom edge 16 for reasons to be described with reference to FIG. 6.

Turning now to the interior of the fan ball 10, a first interior bore 28 is disposed in the fan ball. A second interior bore 30 is disposed longitudinally through the fan ball 10 for receiving a conventional down rod assembly, as will be described with reference to FIG. 6. A plurality of transverse slots 32*a*–*b* are disposed between the first interior bore 28 and the second interior bore 30. A plurality of recesses 34*a*–*c* may further be formed in the fan ball 10 to reduce the materials necessary to form the fan ball.

Referring to FIG. 4, the damping ring 22 is retained in a slot 36. It is understood that the slot 36 may be formed in a variety of shapes so long as it is adapted to receive the damping ring 22.

In one embodiment, the damping ring 22 may comprise a plurality of posts 38 for engaging a plurality of corresponding receptacles 39 formed in the slot 36 of the fan ball 10. Thus, the damping ring 22 may be snap-fit onto the fan ball 10 by fitting the posts 38 to the corresponding receptacles 39.

Alternatively, the damping ring 22 may be injection molded into the slot 36 and the receptacles 39.

It can be appreciated that the damping ring 22 may be further secured into the slot 36 with any conventional adhesive. If adhesive is used, the posts 38 and the corresponding receptacles 39 may not be present.

Figures 5, 6:
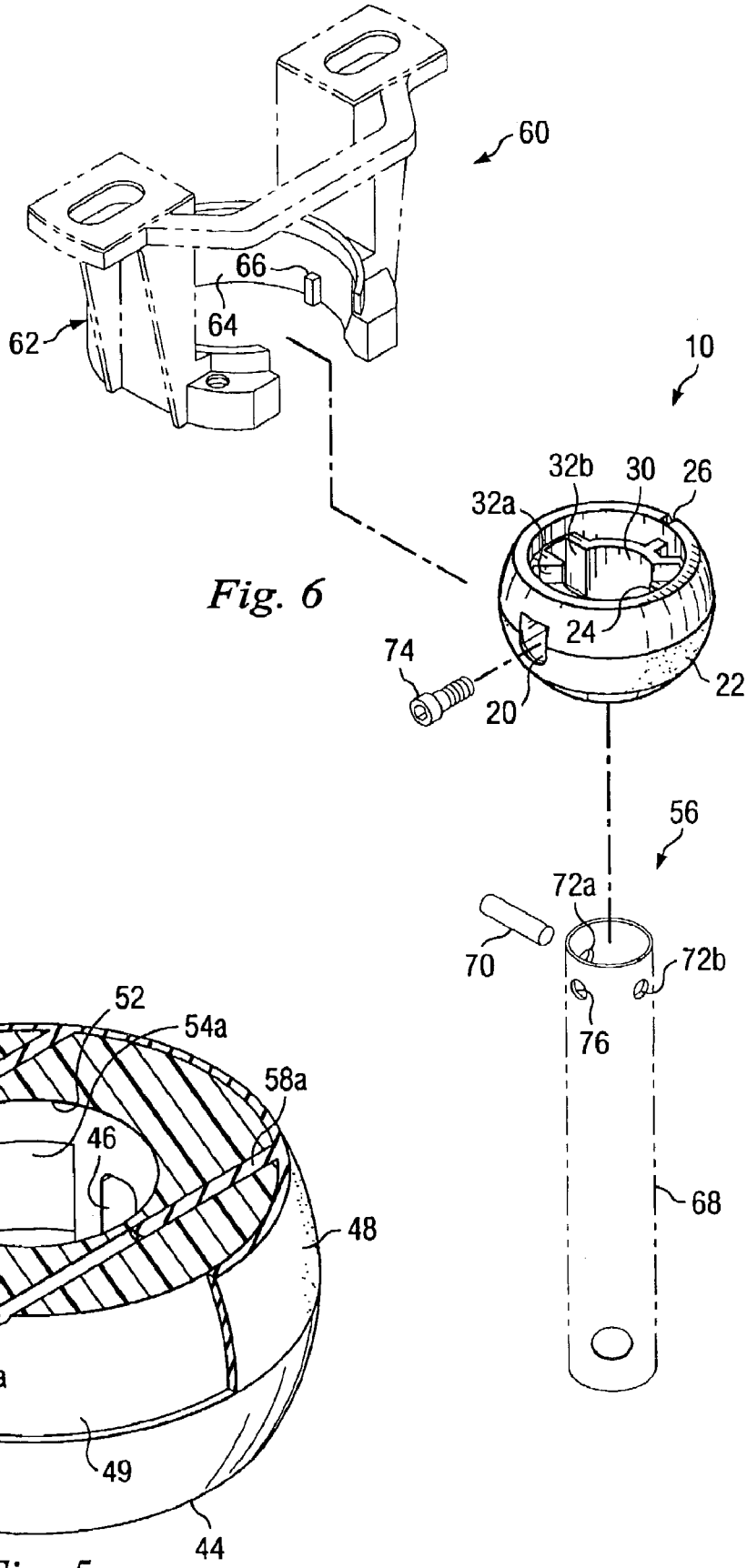
FIG. 5 is a partial sectional bottom view of an alternative embodiment of a fan ball.
FIG. 6 is a perspective view of a fan ball with several conventional mounting components illustrated in phantom.

Referring to FIG. 5, in an alternative embodiment, a fan ball 40 comprises an outer surface 42 and a top edge 44.

As with the previously described embodiment shown in FIGS. 1–4, the outer surface 42 is generally curved for corresponding to the shape of a conventional mounting bracket, as will be described with reference to FIG. 6. A bore 46 is formed radially through a portion of the fan ball 10 for reasons to be described with reference to FIG. 6.

A damping ring 48 is disposed on the fan ball 10 and extends partially circumferentially about the outer surface 42. The damping ring 48 may be formed of rubber, polyethylene, or any material having a damping ability, such materials being well known to those skilled in the art.

The damping ring 48 is retained in a slot 49. It is understood that the slot 49 may be formed in a variety of shapes so long as it is adapted to receive the damping ring 48.

A channel 50 is formed along the outer surface 12, extending from the top edge 44 for reasons to be described with reference to FIG. 6.

Turning now to the interior of the fan ball 40, an interior bore 52 is disposed longitudinally through the fan ball for receiving a conventional down rod assembly, as will be described with reference to FIG. 6. A plurality of transverse slots 54*a*–*b* are disposed in the fan ball 40.

A pair of bores 56*a*–*b* are formed through the fan ball 40 for receiving a portion of the damping ring 48. The damping ring 48 may be injection molded, thus extruding a pair of connector portions 58*a*–*b* of the damping ring through the corresponding bores 56*a*–*b*.

In operation, and referring to FIG. 6, either of the previously described embodiments may be used as part of a ceiling fan mounting assembly 60. For sake of clarity, the operation is described with reference to the fan ball 10. A conventional mounting bracket 62 (illustrated in phantom) is conventionally attached to a fixed surface (not depicted). The mounting bracket 60 comprises a seat 64 adapted to receive the fan ball 10 to form a ball and socket type interaction. It is understood that the fan ball 10 may pivot within the seat 64. In one embodiment, a tab 66 extends from the seat 64 to engage the channel 26 formed in the fan ball 10, thereby allowing the fan ball 10 to pivot only in an arc defined by the plane of the tab.

Before insertion into the mounting bracket 62, the fan ball 10 is attached to a conventional down rod 68 (illustrated in phantom). It is understood that the down rod 68 is coupled to a conventional ceiling fan (not depicted).

The upper portion of the down rod 68 may be inserted into the fan ball 10 via the bore 30. A hanging pin 70 is then inserted radially through a pair of corresponding bores 72*a*–*b* disposed through the down rod 68. The fan ball 10 is then moved longitudinally toward the hanging pin 70 so that the hanging pin engages either of the slots 32*a–b*, thereby preventing the hanging pin from exiting the down rod 68 and evenly distributing the weight of the down rod and ceiling fan across the fan ball.

A connector 74, such as a screw, rod, or the like, can then be inserted through the bore 20 of the fan ball 10 to engage the down rod 68 and prevent longitudinal movement of the down rod with respect to the fan ball. In an alternative embodiment, the down rod 68 may have a radial bore 76 to correspond with the bore 20, the connector 74 passing through both bores.

The fan ball 10, now attached to the down rod 68 and the ceiling fan, is then inserted into the mounting bracket 62, the outer surface 12 engaging the seat 64. Once the ceiling fan (not depicted) is thus mounted, the damping ring 22 prevents the fan ball 10 from mechanically transferring any appreciable degree of vibration from the environment to the fan, thereby preventing undesirable noise.

While the invention has been particularly shown and described with reference to embodiments thereof, it will be understood by those skilled in the art that various changes in form and detail may be made therein without departing from the spirit and scope of the invention. It is also understood that all spatial references, such as "top," "bottom," "upper," "lower," "inner," "outer," "radially," and "longitudinally" are for illustrative purposes only and can be varied within the scope of the invention. Therefore, the claims should be interpreted in a broad manner, consistent with the present invention.

What is claimed is:

1. A ceiling fan mounting assembly, comprising:

a mounting bracket attached to a ceiling, wherein the bracket has a seat;

a fan ball for engaging a ceiling fan down rod, wherein an exterior surface of the fan ball is received in the seat; and a compressible damping element circumferentially disposed integral with the fan ball that compresses between the fan ball and the bracket when the down rod bears a load, wherein the damping element is retained within an indentation formed in the fan ball.

2. The assembly of claim 1 wherein the damping element comprises an outwardly facing surface that is generally flush with the exterior surface of the fan ball.

3. The assembly of claim 1 wherein the damping element comprises an outwardly facing surface that generally conceals the indentation.

4. The assembly of claim 1 wherein the damping element comprises an outwardly facing surface that is generally flush with the exterior surface of the fan ball, the outwardly facing surface of the damping element generally concealing the indentation.

5. The assembly of claim 1 wherein the damping element generally extends throughout the entire indentation.

6. The assembly of claim 1 wherein the fan ball comprises a plurality of bores formed in a surface of the fan ball defined by the indentation; and wherein the damping element comprises a plurality of posts extending into the bores, respectively.

7. A ceiling fan mounting assembly, comprising:

a fan ball comprising:

a generally convex surface, and an indentation formed in the convex surface;

a damping element in the form of a ring extending at least partially circumferentially about the fan ball and retained within the indentation, the damping element comprising:

an outwardly facing surface that is generally flush with the convex surface of the fan ball, the outwardly facing surface generally concealing the indentation;

and a mounting bracket for receiving the fan ball, the mounting bracket comprising a seat for engaging at least a portion of the outwardly facing surface of the damping element.

8. The assembly of claim 7 further comprising a ceiling fan down rod engaged with the fan ball;

wherein, when the ceiling fan down rod bears a load, at least a portion of the damping element compresses at a location corresponding to the engagement between the at least a portion of the outwardly facing surface of the damping element and the seat of the mounting bracket.

9. The assembly of claim 7 wherein the damping element generally extends throughout the entire indentation to form a generally contiguous outer surface for facilitating the engagement between the seat of the mounting bracket and the at least a portion of the outwardly facing surface of the damping element, the generally contiguous outer surface comprising the generally convex surface of the fan ball and the outwardly facing surface of the damping element.

10. The assembly of claim 7 wherein the fan ball further comprises a plurality of bores formed in a surface of the fan ball defined by the indentation; and wherein the damping element further comprises a plurality of posts extending into the bores, respectively.

11. A ceiling fan mounting assembly, comprising:

a ceiling fan down rod;

a fan ball engaged with the ceiling fan down rod, the fan ball comprising:

a generally convex surface, an indentation formed in the convex surface, and a compressible damping element in the form of a ring extending at least partially circumferentially about the fan ball and retained within the indentation, the damping element comprising:

an outwardly facing surface;

wherein the damping element generally extends throughout the entire indentation to form a generally contiguous outer surface, the generally contiguous outer surface comprising the generally convex surface of the fan ball and the outwardly facing surface of the damping element;

and a mounting bracket for receiving the fan ball, the mounting bracket comprising a seat for engaging at least a portion of the generally contiguous outer surface, the at least a portion of the generally contiguous outer surface comprising at least a portion of the outwardly facing surface of the damping element.

12. The assembly of claim 11 wherein, when the ceiling fan down rod bears a load, at least a portion of the compressible damping element compresses at a location corresponding to the engagement between the at least a portion of the generally contiguous outer surface and the seat of the mounting bracket.

13. The assembly of claim 11 wherein the outwardly facing surface of the damping element is generally flush with the convex surface of the fan ball and generally conceals the indentation.

14. The assembly of claim 11 wherein the fan ball further comprises a plurality of bores formed in a surface of the fan ball defined by the indentation; and wherein the damping element further comprises a plurality of posts extending into the bores, respectively.

15. A ceiling fan mounting assembly, comprising:

a ceiling fan down rod;

a fan ball engaged with the ceiling fan down rod, the fan ball comprising:

a generally convex surface, and an indentation formed in the convex surface;

a compressible damping element in the form of a ring extending at least partially circumferentially about the fan ball and retained within the indentation, the damping element comprising:

an outwardly facing surface that is generally flush with the convex surface of the fan ball, the outwardly facing surface of the damping element generally concealing the indentation;

and a mounting bracket for receiving the fan ball, the mounting bracket comprising a seat for engaging at least a portion of the outwardly facing surface of the damping element;

wherein, when the ceiling fan down rod bears a load, at least a portion of the compressible damping element compresses at a location corresponding to the engagement between the at least a portion of the outwardly facing surface of the damping element and the seat of the mounting bracket.

16. The assembly of claim 15 wherein the damping element generally extends throughout the entire indentation to form a generally contiguous outer surface for facilitating the engagement between the seat of the mounting bracket and the at least a portion of the outwardly facing surface of the damping element, the generally contiguous outer surface comprising the generally convex surface of the fan ball and the outwardly facing surface of the damping element.

17. The assembly of claim 15 wherein the fan ball further comprises a plurality of bores formed in a surface of the fan ball defined by the indentation; and wherein the damping element further comprises a plurality of posts extending into the bores, respectively.

18. A ceiling fan mounting assembly, comprising:

a ceiling fan down rod;

a fan ball engaged with the ceiling fan down rod, the fan ball comprising:

a generally convex surface, an indentation formed in the convex surface, and a plurality of bores formed in a surface of the fan ball defined by the indentation;

a compressible damping element in the form of a ring extending at least partially circumferentially about the fan ball and retained within the indentation, the damping element comprising:

a plurality of posts extending into the bores, respectively, and an outwardly facing surface that is generally flush with the convex surface of the fan ball, the outwardly facing surface of the damping element generally concealing the indentation, wherein the damping element generally extends throughout the entire indentation to form a generally contiguous outer surface, the generally contiguous outer surface comprising the generally convex surface of the fan ball and the outwardly facing surface of the damping element;

and a mounting bracket for receiving the fan ball, the mounting bracket comprising a seat for engaging at least a portion of the generally contiguous outer surface, the at least a portion of the generally contiguous outer surface comprising at least a portion of the outwardly facing surface of the damping element;

wherein, when the ceiling fan down rod bears a load, at least a portion of the compressible damping element compresses at a location corresponding to the engagement between the at least a portion of the generally contiguous outer surface and the seat of the mounting bracket.

* * * * *